US006614147B2

(12) United States Patent
Koizumi et al.

(10) Patent No.: US 6,614,147 B2
(45) Date of Patent: Sep. 2, 2003

(54) CATHODE RAY TUBE HAVING AN IMPROVED INDIRECTLY HEATED CATHODE STRUCTURE

(75) Inventors: Sachio Koizumi, Mobara (JP); Toshifumi Komiya, Sakura (JP); Norio Iwamura, Chousei (JP)

(73) Assignee: Hitachi, Ltd., Tokyo (JP)

( * ) Notice: Subject to any disclaimer, the term of this patent is extended or adjusted under 35 U.S.C. 154(b) by 381 days.

(21) Appl. No.: 09/756,746

(22) Filed: Jan. 10, 2001

(65) Prior Publication Data

US 2001/0015613 A1 Aug. 23, 2001

(30) Foreign Application Priority Data

Jan. 11, 2000 (JP) ..... 2000-006163

(51) Int. Cl.[7] ..... H01J 1/52; H01J 19/40
(52) U.S. Cl. ..... 313/270
(58) Field of Search ..... 313/250, 252, 313/257, 249, 265, 270, 271, 37, 337, 340, 341, 343, 344, 345, 346, 366, 417, 422, 474

(56) References Cited

U.S. PATENT DOCUMENTS

| | | | | |
|---|---|---|---|---|
| 3,895,249 A | | 7/1975 | Andre et al. | |
| 4,149,104 A | | 4/1979 | Yoshimori | |
| 4,611,146 A | | 9/1986 | Morrison | |
| 4,827,184 A | * | 5/1989 | Spanjer et al. | 313/450 |
| 4,853,589 A | * | 8/1989 | Vrijssen | 313/477 R |
| 4,868,455 A | * | 9/1989 | Vrijssen | 313/451 |
| 5,543,682 A | | 8/1996 | Hara et al. | |
| 5,565,742 A | * | 10/1996 | Shichao et al. | 315/366 |
| 5,762,997 A | | 6/1998 | Hara et al. | |
| 6,191,528 B1 | * | 2/2001 | Iwamura et al. | 313/446 |
| 6,492,768 B1 | * | 12/2002 | Koizumi et al. | 313/446 |

FOREIGN PATENT DOCUMENTS

| | | |
|---|---|---|
| JP | 57-34671 | 7/1982 |
| JP | 60-3483 | 1/1985 |
| JP | 2-160332 | 6/1990 |
| JP | 3-084827 | 4/1991 |
| JP | 4-292830 | 10/1992 |
| JP | 6-21145 | 3/1994 |
| JP | 6-22095 | 3/1994 |
| JP | 7-161282 | 6/1995 |
| JP | 7-254352 | 10/1995 |
| JP | 8-3976 | 1/1996 |
| JP | 11-213859 | 8/1999 |
| JP | 11-273549 | 10/1999 |
| KR | 1989-0002946 | 4/1989 |
| KR | 1994-022619 | 10/1994 |
| KR | 1998-013749 | 5/1998 |
| WO | WO97/22131 | 6/1997 |

* cited by examiner

*Primary Examiner*—William Oen
(74) *Attorney, Agent, or Firm*—Antonelli, Terry, Stout & Kraus, LLP

(57) ABSTRACT

A cathode ray tube has a phosphor screen and an electron gun including an indirectly heated cathode structure and a plurality of electrodes disposed downstream of the indirectly heated cathode structure for projecting an electron beam toward the phosphor screen, and a deflection yoke for scanning the electron beam on the phosphor screen. The indirectly heated cathode structure includes: a base metal having an electron emissive material coating on an outer top surface thereof; a metal sleeve having the base metal attached to an end of the metal sleeve; a heater housed partly within the metal sleeve which includes a major heating portion formed of a spirally wound heating wire and leg portions formed of heating wires wound spirally in a plurality of layers; an insulating film covering the major heating portion and a portion of each of the leg portions continuous with the major heating portion; and a black coating film covering a portion of the insulating film extending from the major heating portion toward each of the leg portions, the whole of the black coating film being housed within the metal sleeve.

13 Claims, 5 Drawing Sheets

CATHODE RAY TUBE HAVING AN IMPROVED INDIRECTLY HEATED CATHODE STRUCTURE

BACKGROUND OF THE INVENTION

The present invention relates to a cathode ray tube having an electron gun employing an indirectly heated cathode, and in particular to a highly-reliable long-life cathode ray tube having prevented occurrence of leakage current by improving insulating characteristics between a cathode sleeve and a heater of the indirectly heated cathode.

Cathode ray tubes used for a color television receiver, a display monitor and the like are widely used in various fields as display means because of their capability of reproducing high-definition images.

Cathode ray tube of this kind includes a vacuum envelope formed of a panel portion, a neck portion and a funnel portion for connecting the panel portion and the neck portion, a phosphor screen formed of phosphors coated on an inner surface of the panel portion, an electron gun housed in the neck portion, and comprised of a plurality of electrodes such as an indirectly heated cathode, a control electrode and an accelerating electrode for projecting an electron beam toward the phosphor screen, and a deflection yoke mounted around the funnel portion for scanning the electron beam emitted from the electron gun over the phosphor screen. The electron gun usually employs an indirectly heated cathode.

FIG. 5 is a cross-sectional view of an essential part of an indirectly heated cathode and its vicinity of a prior art cathode ray tube. In FIG. 5, reference numeral 51 denotes an indirectly heated cathode structure, the indirectly heated cathode structure 51 comprises a tubular cathode sleeve 52, a cap-shaped cathode cap 53 fixed at an end of the cathode sleeve 52, an electron-emissive material layer 54 coated on a top surface of the cathode cap 53, and a heater 55 a portion of which is disposed within the cathode sleeve 52 for heating the cathode cap 53.

A portion of a spirally wound heating wire 55*a* of the heater 55 is covered with an insulating film 55*b* made chiefly of alumina and a coating film 55*c* containing alumina and tungsten powder. Of the insulating film 55*b* and the coating film 55*c*, the insulating film 55*b* covers all the heating wire 55*a* of the heater 55 extending to ends 55*e* except for end portions 55*d* for welding, and the coating film 55*c* covers the outer surface of approximately all the insulating film 55*b* except for the vicinity of the ends 55*e* of the insulating film 55*b* extending from a coil portion 55*f* on the side of the top of the cathode sleeve 52 to ends 55*g* beyond a flared bottom end 52*a* of the cathode sleeve 52.

The coating film 55*c* contains a small amount of tungsten powder as described above and appears black, and the insulating film 55*b* is made chiefly of alumina and appears white, but the heater 55 appears black as a whole, and this type of heaters are generally called dark heaters.

The heater 55 is welded to heater supports 56 at its end portions 55*d* for welding. The cathode sleeve 52 is fixed to a small-diameter portion of a cathode cylinder 58, a large-diameter portion of which is fixed to a tubular cathode support eyelet 57. The cathode support eyelet 57 and the heater supports 56 are fixed to a pair of multiform glasses 61 via bead supports 59 and via heater lead straps 60, respectively. Reference numeral 62 denotes a control electrode which is fixed to the multiform glasses 61 with a desired spacing between it and the electron-emissive material layer 54.

The techniques for employing such dark heaters are described in the following references, for example.

Japanese Patent Publication No. Hei 8-3976 (published on Jan. 17, 1996) discloses a technique for improving withstand voltage characteristics by preventing deformation and cracking of an insulating alumina film of a heater using insulating alumina powder of specified average diameters.

Japanese Patent Application Laid-open No. Hei 7-161282 (laid-open on Jun. 23, 1995) discloses a technique for suppressing a leakage current between a heater and a cathode by combining a dark heater with a cathode sleeve having a silicon carbide film on its inner surface.

Japanese Patent Application Laid-open No. Hei 11-213859 (laid-open on Aug. 6, 1999) discloses a technique for suppressing a leakage current between a heater and a cathode by dispersing at least one of niobium and tantalum in a film made of a mixture of tungsten and alumina and coated on at least one of an inner surface of a cathode sleeve and a surface of the heater.

Japanese Patent Application Laid-open No. Hei 11-273549 (laid-open on Oct. 8, 1999) discloses a technique for suppressing a leakage current between a heater and a cathode by improving purity of alumina used for insulation of the heater and thereby increasing electrical resistance of the alumina itself.

Japanese Utility Model Publication No. Sho 60-3483 (Jan. 31, 1985) discloses a technique for preventing cracking of alumina by extending a dark-film region to cover a three-layer winding portion of each leg portion of a heater.

SUMMARY OF THE INVENTION

Cathode ray tubes employing such dark heaters have a feature in that heat can be efficiently radiated from a heater because the outer surface of the heater is darkened and thereby heat radiation efficiency of the surface of the heater is increased, and consequently, their reliability can be improved.

However, the prior art structure shown in FIG. 5, or the techniques disclosed in the above-cited references are not sufficient for preventing the leakage current between the heater and the cathode. In an automatic cutoff-voltage control circuit for controlling a cathode current to a predetermined value and used in a color television receiver or a display monitor, the leakage current between the heater and the cathode is superposed on the cathode current. Consequently, there is a problem in that, if the predetermined value of the cathode current in the color television receiver or the display monitor is not sufficiently large compared with a value of the leakage current between the heater and the cathode, the automatic cutoff-voltage control circuit cannot control the cutoff voltages of the electron beams for three colors of red, green and blue, a balance among the three colors is lost such that white balance is not obtained, the automatic cutoff-voltage control circuit is inoperable and the adjustment of the receiver or the monitor becomes difficult.

If the leakage current between the heater and the cathode begins to flow, the alumina film serving as a heater insulating film is heated by the leakage current, oxygen escapes from the alumina due to the heat, and electrical conductivity occurs in the oxygen-deficient alumina ($Al_2O_{2.99}$). As a result, there are various problems, and the heater is sometimes broken by a further increase in the leakage current, and therefore it is important in view of ensuring reliability of a cathode ray tube to prevent the leakage current between the heater and the cathode.

The following two causes are confirmed for occurrence of the leakage current between the heater and the cathode.

As for a first one of the two causes, it was found out that, in cathode ray tubes rejected for the leakage current between the heater and the cathode, many insulating films 55*b* which should otherwise be white have turned gray. The analysis confirmed that the cause of this coloration is tungsten.

Tungsten present within a cathode ray tube is used in the heating wire 55*a* of the heater 55 and the above-mentioned coating film 55*c*. If the two are compared with each other, tungsten contained in the coating film 55*c* is of a small powder size of about 1.0 $\mu$m in diameter, and is chemically active compared with the heating wire 55*a*.

The degree of vacuum of the cathode ray tube is poorest immediately after flashing of getters in the manufacturing step, that is, about $10^{-2}$ Pa. After flashing of the getters, decomposition of residual gases within the tube by an electron beam and adsorption of the residual gases by the getter film provide the ultimate degree of vacuum of about $10^{-5}$ Pa. It was found out that the mean free paths of the residual gases are about several tens cm in the poorest degree of vacuum (about $10^{-2}$ Pa) and the residual gases react with portions having directly exposed tungsten within the tube.

It was confirmed from the above facts that the residual gases collide with fine tungsten powder especially in the portions of the dark coating film 55*c* extending from the vicinities of the flared bottom end 52*a* of the cathode sleeve 52 outwardly to the ends 55*g* of the dark coating film 55*c*, then the tungsten is dispersed into the alumina of the insulating film 55*b*, the alumina is brought into a semiconductor state by the water cycle phenomenon (see Horikoshi, G.: "Vacuum Technology (second edition)," chap. 4.2.8, p. 85, Tokyo University Press, for example.), and thereby the alumina film produces an electrical conductivity and increases the leakage current between the heater and the cathode.

A second one of the two causes for occurrence of the leakage current between the heater and the cathode is occurrence of the leakage current due to the physical contact between the heater and the cathode sleeve. This is caused by the fact that leg portions of the heater 55 are pulled apart when the leg portions of the heater 55 are welded to heater supports 56 and the contact area between the heater and the cathode sleeve 52 is increased in the vicinity of the flared bottom end 52*a* of the cathode sleeve 52.

It is an object of the present invention to provide a superior cathode ray tube having prevented the leakage current between the heater and the cathode by solving the above problems with the prior art.

To achieve the above object, the present invention provides a superior cathode ray tube having prevented the leakage current between the heater and the cathode by specifying a relationship between a cathode sleeve of an indirectly heated cathode of an electron gun and a coating length of a coating film of the heater inserted in the cathode sleeve such that collisions and consequent reactions between the residual gases within the tube and the coating film of the heater are reduced and at the same time the contact area between the heater and the cathode sleeve is reduced.

In accordance with an embodiment of the present invention, there is provided a cathode ray tube having an evacuated envelope including a panel portion, a neck portion, a funnel portion for connecting the panel portion and the neck portion and a stem having a plurality of pins therethrough and being sealed to close the neck portion at one end thereof, a phosphor screen formed on an inner surface of the panel portion, an electron gun housed in the neck portion, the electron gun having an indirectly heated cathode structure and a plurality of electrodes disposed downstream of the indirectly heated cathode structure, spaced specified distances apart, arranged axially in a specified order, and fixed by insulating rods for projecting an electron beam toward the phosphor screen, and a deflection yoke mounted around a vicinity of a transitional region between the neck portion and the funnel portion for scanning the electron beam on the phosphor screen, the indirectly heated cathode structure comprising: a base metal having an electron emissive material coating on an outer top surface thereof; a metal sleeve having the base metal attached to a first end of the metal sleeve and having a second end opposite from the first end; a heater housed partly within the metal sleeve, the heater including a major heating portion having a spirally wound heating wire and leg portions connected to respective ends of the major heating portion and comprising heating wires wound spirally in a plurality of layers; an insulating film covering the major heating portion and a portion of each of the leg portions continuous with the major heating portion; and a black coating film covering a portion of the insulating film extending from the major heating portion toward each of the leg portions, a whole of the black coating film being housed within the metal sleeve.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

The embodiment of the present invention will be explained in detail by reference to the drawings.

Figure 1:
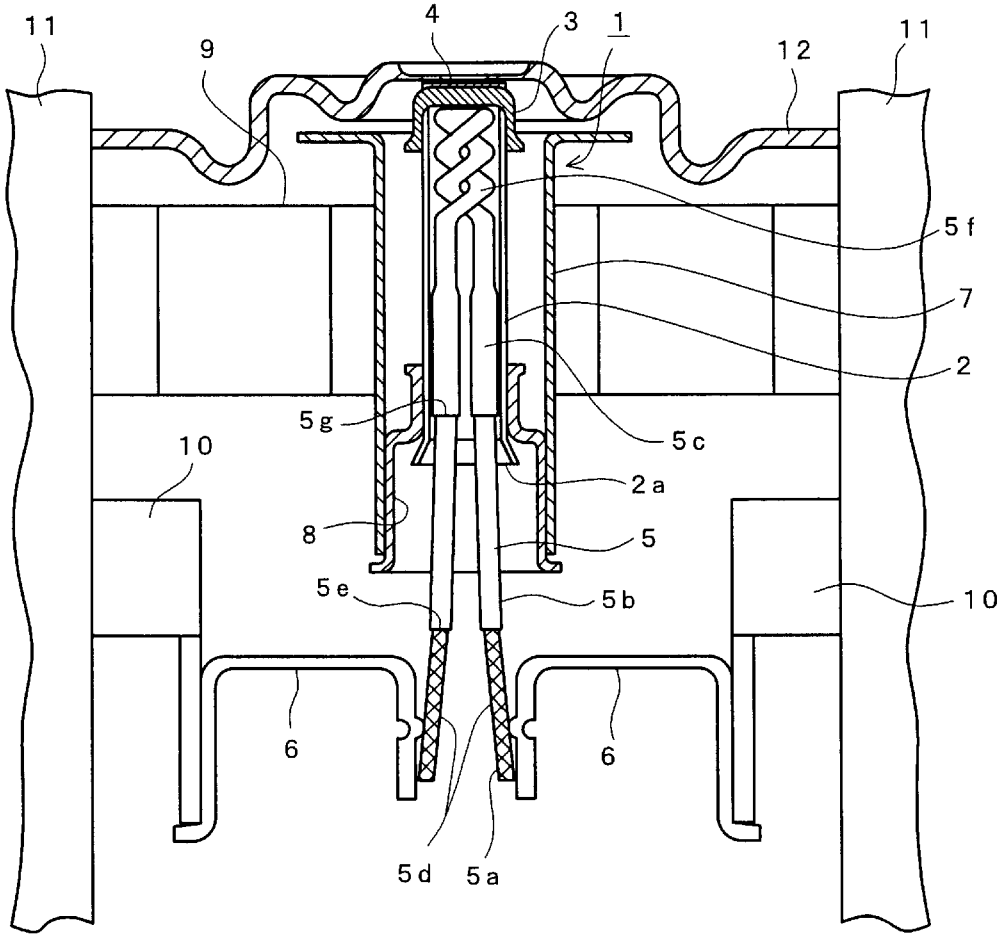
FIG. 1 is a cross-sectional view of an essential part of an indirectly heated cathode structure and its vicinity in an embodiment of a cathode ray tube in accordance with the present invention.

FIG. 1 is a cross-sectional view of an essential part of an indirectly heated cathode structure and its vicinity in an embodiment of a cathode ray tube in accordance with the present invention. In FIG. 1, reference numeral 1 denotes an indirectly heated cathode structure. The indirectly heated cathode structure 1 includes a cylindrical sleeve 2, a cap-shaped cathode cap 3 fixed at an end of the cathode sleeve 2, an electron-emissive material layer 4 coated on a top surface of the cathode cap 3, and a heater 5 a portion of which is disposed in the cathode sleeve 2 for heating the cathode cap 3. A portion of a spirally wound heating wire 5*a* of the heater 5 is coated with two layers of an insulating film 5*b* made chiefly of alumina and a coating film 5*c* containing alumina and tungsten fine powder.

Exemplary dimensions of the cathode sleeve 2 are as follows:

Wall thickness=0.018 mm,

Outside diameter=1.6 mm,

Axial length=7 mm.

Of the insulating film 5*b* and the coating film 5*c*, the insulating film 5*b* covers all the heating wire 5*a* of the heater 5 extending from ends 5*e* to a coiled portion 5*f* on a top side of the cathode sleeve 2 except for end portions 5*d* for welding, and the coating film 5*c* covers outer surfaces of the insulating film 55*b* extending from the coiled portion 5*f* on a top side of the cathode sleeve 2 to ends 5*g* within a flared bottom end 2*a* of the cathode sleeve 2.

In other words, for the purpose of disposing the whole of the coating film 5*c* within the cathode sleeve 2, the edges 5*g* of the coating film 5*c* is displaced toward the coiled portion 5*f* from the ends 5*e* of the insulating film 5*b* on the sides of the end portions 5*d* for welding and is within the flared bottom end 2*a* of the cathode sleeve 2 such that the ends 5*g* of the coating film 5*c* are displaced toward the electron-emissive material layer 4 from the bottom ends 2*a*.

As described above, the coating film 5*c* contains alumina and tungsten powder, and is a black coating film which appears black, and on the other hand, the insulating film 5*b* is made chiefly of alumina, and therefore is a white insulating film which appears white.

With this structure, the whole of the black coating film of the heater is disposed within the cathode sleeve, contacts and consequent reactions between the residual gases within the tube and the black coating film are reduced and therefore tungsten does not disperse into alumina, and consequently, dielectric strength characteristics of alumina are not degraded and therefore the leakage current is prevented. In addition, the thickness of the insulating film of the heater in the vicinity of the flared portion of the cathode sleeve is reduced, and therefore the contact area between the cathode sleeve and the heater is reduced such that the leakage current is prevented.

The insulating film 5*b* may be formed of a plurality of sub-layers each containing alumina powder different in size, for example, and also the coating 5*c* may be formed of a plurality of sub-layers containing alumina powder different in size or containing tungsten different in proportion, for example.

In addition, it suffices to level the ends 5*g* with the flared bottom end 2*a* of the cathode sleeve 2, or to dispose the ends 5*g* within the flared bottom end 2*a*, and it is more preferable to dispose the ends 5*g* within the beginning end of the flared portion of the cathode sleeve 2 on the cathode cap side.

The heater 5 is welded to heater supports 6 at its end portions 5*d* for welding. The cathode sleeve 2 is fixed to a small-diameter portion of a cathode cylinder 8, a large-diameter portion of which is fixed to a tubular cathode support eyelet 7. The cathode support eyelet 7 and the heater supports 6 are fixed to a pair of multiform glasses 11 via bead supports 9 and via heater lead straps 10, respectively. Reference numeral 12 denotes a control electrode which is fixed to the multiform glasses 1 with a desired spacing between it and the electron-emissive material layer 4.

Figure 2A:
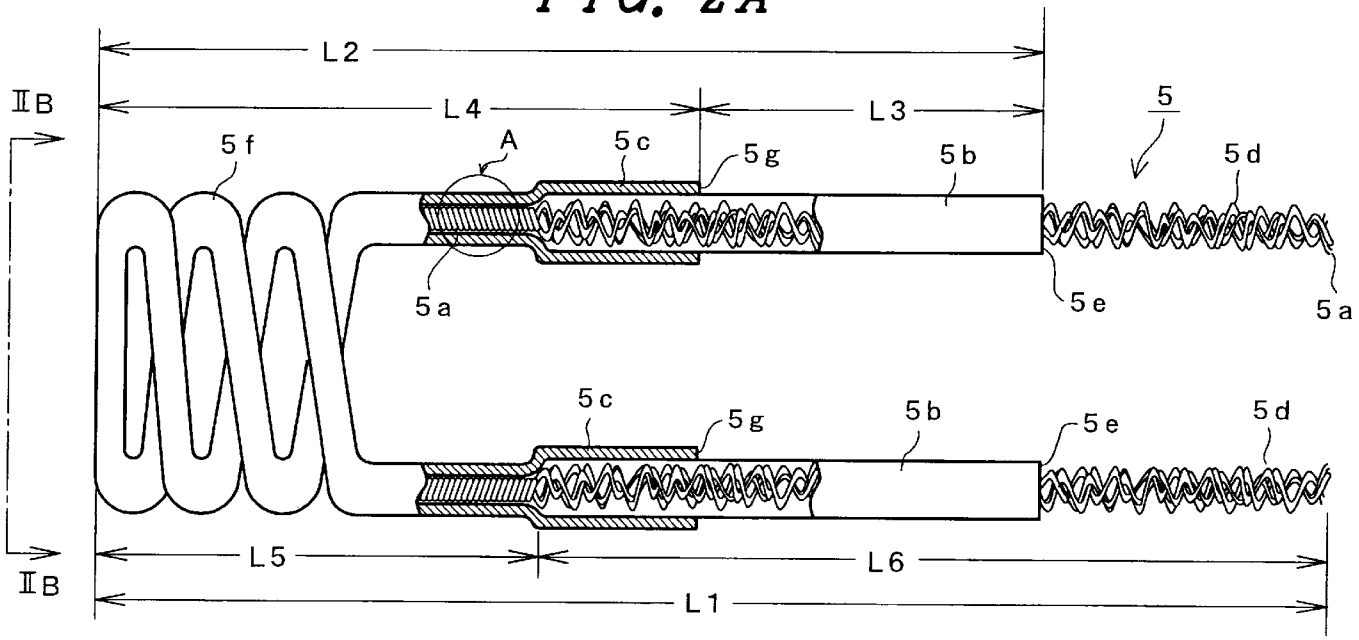
FIGS. 2A to 2C are detailed views of an example of the heater of FIG. 1, FIG. 2A being a plan view thereof, FIG. 2B being a side elevation view along section line IIB—IIB of the heater of FIG. 2A and FIG. 2C being an enlarged cross-sectional view of the circled portion, designated "A", of the heater of FIG. 2A.
Figure 2C:
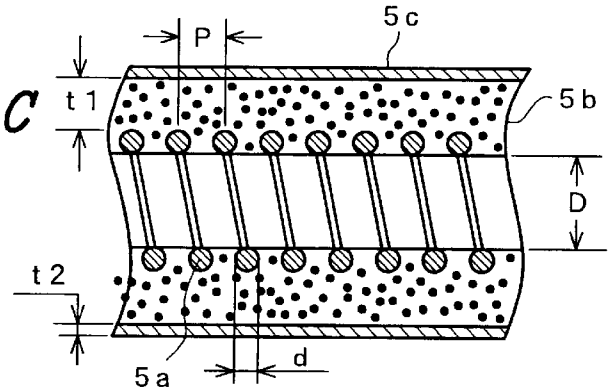
Figure 2B:
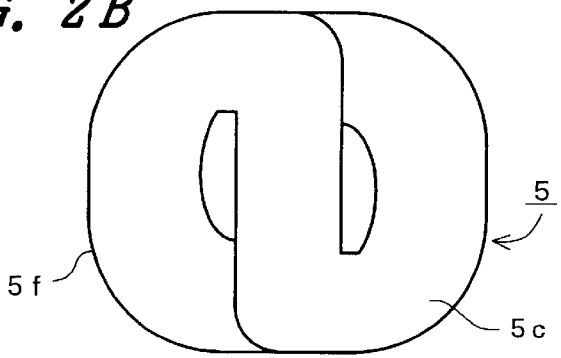

FIGS. 2A to 2C are detailed views of an example of the heater of FIG. 1, FIG. 2A is a plan view thereof, FIG. 2B is a side elevation view along section line IIB—IIB of the heater of FIG. 2A and FIG. 2C is an enlarged cross-sectional view of the circled portion, designated "A", of the heater of FIG. 2A. The same reference numerals as utilized in FIG. 1 designate corresponding portions in FIGS. 2A to 2C.

In FIGS. 2A to 2C, the heater 5 is covered with the insulating film 5*b* in a region extending a length L2 of the overall length L1 except for the end portions 5*d* for welding, and further an outer surface of the insulating film 5*b* is covered with the coating film 5*c* in a region extending from the coiled portion 5*f* toward the end portions 5*d* for welding as far as the ends 5*g* except for a single-layer portion L3.

Reference character L4 denotes a length of the overlapped portion of the insulating film 5*b* and the coating film 5*c*, L5 is a single-layer winding portion of the heating wire 5*a*, L6 is a plural-layer winding portion of the heating wire 5*a*. For the winding configuration of the heating wire 5*a*, a three-layer winding configuration disclosed in U.S. Pat. No. 4,149,104 issued on Apr. 10, 1979 (which corresponds to Japanese Utility Model Publication Sho 57-34671 published on Jul. 30, 1982) may be employed.

Greater detail of the three-layer winding configuration of the heater and a method of fabricating it are contained in U.S. Pat. No. 4,149,104, and this patent is incorporated by reference herein for the purpose of disclosure.

In FIGS. 2A to 2C, reference character D denotes a diameter of a hollow formed in the heater by dissolving a winding mandrel, d is a diameter of the heating wire 5*a*, p is a winding pitch of the heating wire 5*a*, t1 is a thickness of the insulating film 5*b*, and t2 is a thickness of the coating film 5*c*.

The following explains an example of a method of fabricating the heater 5.

First, a tungsten wire of 0.032 mm in diameter for the heating wire 5*a* is wound around a mandrel made of a molybdenum wire of 0.15 mm in diameter with a pitch of 15 turns/mm for the single-layer winding portion L5 and the plural-layer winding portions L6 employs a three-layer winding structure disclosed in U.S. Pat. No. 4,149,104 (which corresponds to Japanese Utility Model Publication Sho 57-34671).

An example of the three-layer winding structure is as follows:

Winding pitch of the first layer (the innermost layer)=5 turns/mm

Winding pitch of the second layer (the intermediate layer)=5 turns/mm

Winding pitch of the third layer (the outermost layer)=15 turns/mm

Next, the wound heating wire is cut to a specified length, and then is again wound spirally to form the double helical single-layer winding portion L5.

Then, the heater is coated with the insulating film 5*b* in a region designated as L2, of the overall length L1 except for the end portions 5*d* for welding by using a technique of electrodeposition. The coating thickness by electrodeposition is chosen such that the thickness of the insulating film 5*b* becomes about 80 $\mu$m after it is fired at about 1600° C.

One liter of a solution for electrodepositing the insulating film 5*b* is composed of 670 grams of 99.85%-pure powdered alumina (4.4 $\mu$m in average diameter), 440 ml of denature alcohol and 440 ml of distilled water, and the solution is mixed with 14 grams of each of magnesium nitrate and aluminum nitrate which act as electrolytes.

The electrodeposition was carried out with the heater connected to a negative terminal of a 70 V power source. The thickness of the alumina coating film is controlled by adjusting the length of time for electrodeposition. After the electrodeposition, the black coating film 5*c* is formed on a portion of L4 in length of the insulating film 5*b* except for the single-layer film portion designated "L3" to a thickness of about 10 μm by using a dip coating technique which is disclosed in Japanese Patent Publication Hei 6-22095 (published on Mar. 23, 1994).

One liter of a solution for coating the black coating film 5*c* is roughly composed of 450 grams of the same powdered alumina as used in the solution for the electrodeposition of the insulating film 5*b,* 220 grams of tungsten fine powder of 1 μm in average diameter, 700 grams of methyl isobutyl ketone and 110 ml of ethyl ether and is mixed with 17 grams of nitrocellulose which acts as a binder. After the dip coating, the coating thickness is thinned to be 10 μm by washing the blackcoating film 5*c* using ethyl alcohol. The coating length of the coating film 5*c* is easily controlled by adjusting a depth of dipping into the black coating solution.

Then, after a specified drying step and a firing step at 1600° C., the winding mandrel is dissolved by using acid and as a result, a hollow represented by a diameter D is formed as shown in FIG. 2C.

In the above-example, the tungsten fine powder was used for the black coating film 5*c*, but tungsten carbide fine powder can also be used for the black coating film 5*c* instead of the tungsten fine powder. A mixture of tungsten fine powder and tungsten carbide fine powder can also be used for the black coating film 5*c*.

A numeral example of the heater 5 obtained by using this method is as follows:

Overall length L1=13 mm,

Coating length L2 of the insulating film 5*b*=9.5 mm,

Coating length L4 of the coating film 5*c*=6 mm,

Coating thickness t1=80 μm, coating thickness t2=10 μm.

Figure 3:
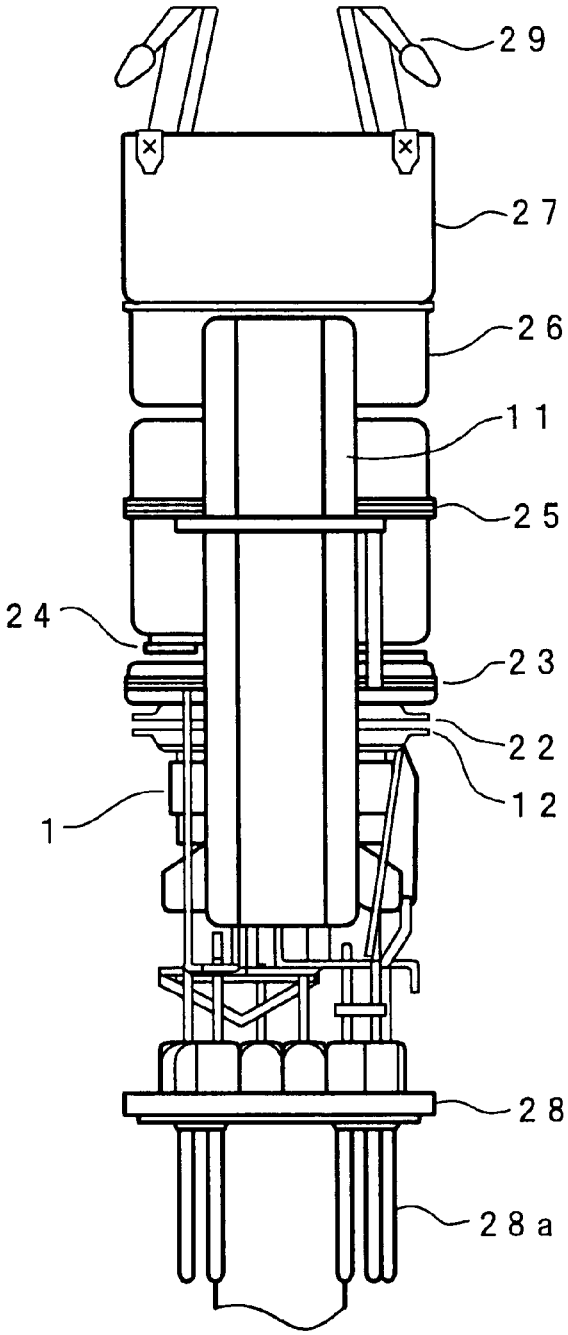
FIG. 3 is a side view of an example of an electron gun used for a shadow mask type color cathode ray tube in accordance with the present invention.

FIG. 3 is a side view of an example of an electron gun used for a cathode ray tube of the present invention employing an indirectly heated cathode structure shown in FIG. 1, and the same reference numerals as utilized in FIG. 1 designate corresponding portions in FIG. 3.

The electron gun of FIG. 3 comprises a control electrode (the first grid electrode, G1) 12, an accelerating electrode (the second grid electrode, G2) 22, focus electrodes (the third grid electrode, G3; the fourth grid electrode, G4; and the fifth grid electrode, G5) 23, 24, 25, an anode (the sixth grid electrode, G6) and a shield cup 27 axially arranged in a specified order with specified spacings therebetween and fixed on a pair of multiform glasses 11, and tabs provided to or leads connected to the respective electrodes are connected to corresponding ones of stem pins 28*a* implanted in a stem 28.

In this electron gun, the indirectly heated cathode structure 1 is closely spaced from the control electrode 12 toward the stem 28, and housed within the indirectly heated cathode structure 1 is the heater 5 for heating the electron-emissive material layer described in connection with FIGS. 2A to 2C.

Reference numeral 29 denote bulb spacer contacts which serve to align the axis of the electron gun with the longitudinal axis of the tube by pressing on an inner wall of a neck portion of a vacuum envelope of the cathode ray tube resiliently, and to introduce an anode voltage to the electron gun from an internal conductive film coated on the inner walls of the funnel and neck portions of the vacuum envelope.

The control electrode 12, the accelerating electrode 22 and the indirectly heated cathode 1 form an electron beam generating section (a triode section). The focus electrodes 23 to 25 accelerate and focus electron beams emitted from the electron beam generating section, and then a main lens formed between the focus electrode 25 and the anode 26 exerts a specified focusing action on the electron beams and directs the electron beams toward a phosphor screen.

The stem 28 is fused and bonded to an open end of the neck portion of the vacuum envelope, and external signals and voltages are applied to corresponding ones of the electrodes via the stem pins 28*a*.

Figure 4:
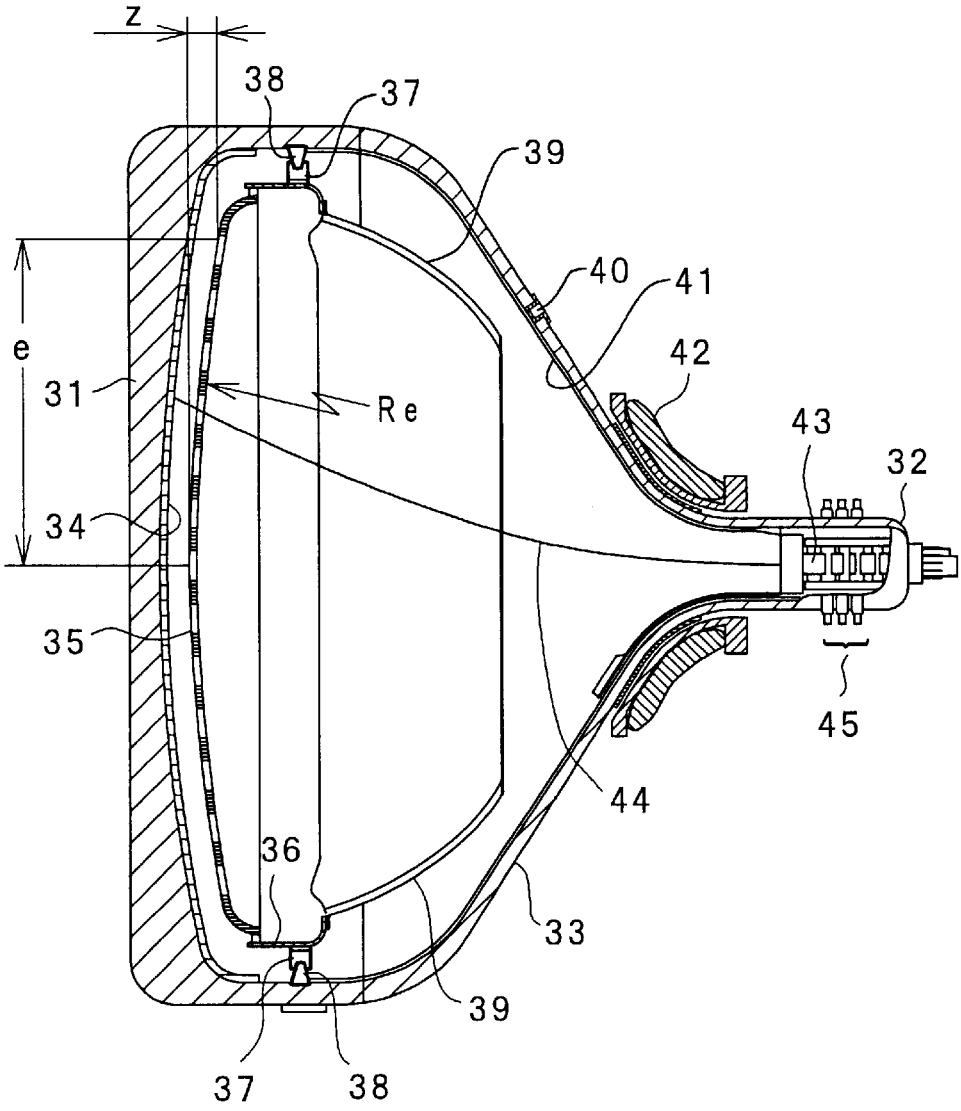
FIG. 4 is a schematic cross-sectional view of a shadow mask type color cathode ray tube of an example of a cathode ray tube in accordance with the present invention.

FIG. 4 is a schematic longitudinal cross-sectional view of a shadow mask type color cathode ray tube in accordance with an embodiment of a cathode ray tube of the present invention for explaining its overall structure roughly. In FIG. 4, reference numeral 31 denotes a panel portion, 32 is a neck portion, 33 is a funnel portion, 34 is a phosphor film, 35 is shadow mask having a large number of electron beam apertures therein and serving as a color selection electrode, which is disposed coaxially with the phosphor film 34 and is spaced a predetermined distance from the phosphor film 34. Reference numeral 36 denotes a mask frame which holds the shadow mask 35 in place and others with a structure to be described subsequently.

Reference numeral 37 are springs, 38 are panel pins, 39 is a magnetic shield for shielding an external magnetic field (the Earth's magnetic field) and preventing trajectories of the electron beams from being changed by the Earth's magnetic field, 40 is an anode button, 41 is an internal conductive coating, 42 is a deflection yoke for deflecting the electron beams horizontally and vertically, 43 is an electron gun having an indirectly heated cathode for emitting three electron beams 44 (a center electron beam and two side electron beams).

Reference 45 denotes an external magnetic correction device (a magnet assembly) which has a function of correcting misregister between electron beam spots and phosphor elements caused by delicate eccentricity between the electron gun and an assembly of the panel portion, the funnel portion and the shadow mask, or rotational misalignment between the electron gun and the assembly of the panel portion, the funnel portion and the shadow mask.

In FIG. 4, the mask frame 36 having fixed thereto the shadow mask 35, the magnetic shield 39 and others is mounted on the panel pins 38 via the springs 37 within a bulb comprised of the panel portion 31 having the phosphor film 34 on its inner surface and the funnel portion 33, then the panel portion 31 and the funnel portion 33 are joined together with fused frit glass, the electron gun 43 is sealed into the neck portion 32, and the envelope formed of the panel portion 31, the funnel portion 33 and the neck portion 32 is vacuum-sealed.

The electron beams 44 emitted from the electron gun 43 are modulated by video signals from an external signal processing circuit (not shown), are projected toward the phosphor screen 34, and are deflected horizontally and vertically by the deflection yoke 42 mounted around the transition region between the neck portion 32 and the funnel portion 33, then pass through electron beam apertures in the shadow mask 35 serving as the color selection electrode and impinge upon the phosphor film 34 to form images.

As color TV receivers and color display monitors of a flat-screen type spread recently, there is a tendency for the faceplate (the panel glass) to be made flat in color cathode ray tubes used for those.

The embodiment of the present invention shown in FIG. 4 is a shadow mask type color cathode ray tube of the flat-screen type. In FIG. 4, the outer surface of the panel portion 31 is approximately flat, and its inner surface is concavely curved. The shadow mask 35 is fabricated by press-forming a shadow mask blank into a shape having a specified curvature conforming to the inner surface of the panel portion 31. The reason why the inner surface of the panel portion 31 and the shadow mask 35 are curved irrespective of the approximately flat outer surface of the panel portion 31 is that a method of fabricating the shadow mask 5 by a press-forming technique is simple and the cost of the shadow mask 5 is low.

A major surface of the shadow mask 35 including an apertured area formed with a large number of electron beam apertures is approximately rectangular, has different radiuses of curvature along the major axis, the minor axis and the diagonals, of the major surface, respectively. This is intended to obtain the compatibility of creation of a sense that a picture on the screen of the color cathode ray tube is flat, with the maintenance of mechanical strength of the formed shadow mask.

The curved surface of the shadow mask 35 in the present embodiment is aspheric, and the radiuses of curvature of the shadow mask 35 decrease gradually with increasing distance from the center of the major surface of the shadow mask 35 toward the peripheries of the major surface, along the major axis, the minor axis and the diagonals of the major surface, respectively. The radius Rx of curvature along the major axis varies from 1450 mm to 1250 mm, the radius Ry of curvature along the minor axis varies from 2000 mm to 1300 mm, and the radius Rd of curvature along the diagonals varies from 1600 mm to 1250 mm. The radius of curvature of this aspheric shadow mask can be defined as the following equivalent radius Re of curvature:

$$Re=(z^2+e^2)/(2z),$$

where e (mm) is a distance between the center of the major surface of the shadow mask and an arbitrary peripheral position of the major surface, as measured perpendicularly to the tube axis, and z (mm) is a distance between the arbitrary peripheral position and a plane passing through the center of the major surface and perpendicular to the tube axis.

As described above, even if the radius along the major axis is somewhat smaller than that along the minor axis, this does not impair the sense that a picture on the screen of the color cathode ray tube is flat, and the equivalent radius of curvature equal to or more than 1250 mm is sufficient for the purpose.

Figure 5:
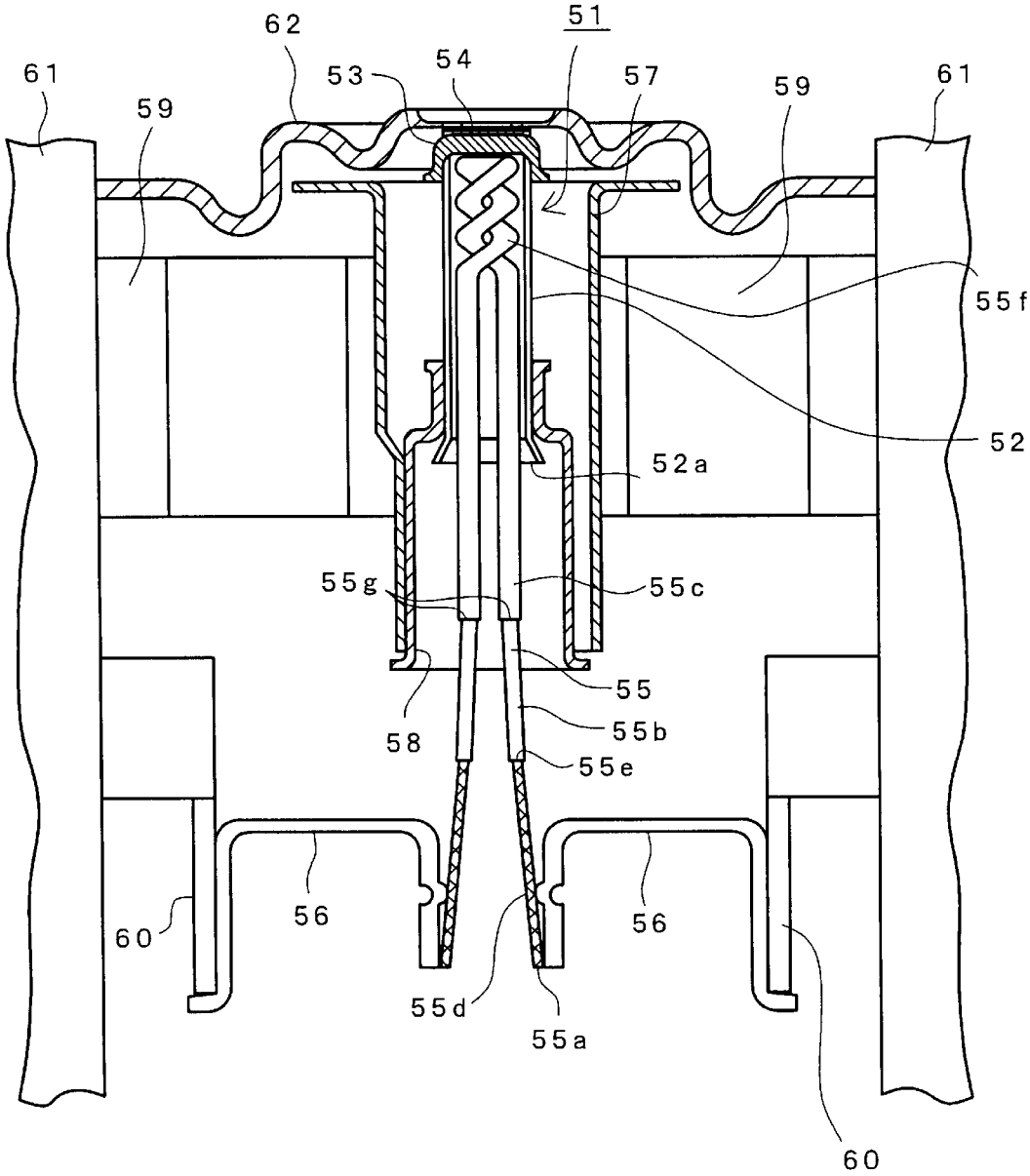
FIG. 5 (PRIOR ART)
FIG. 5 is a cross-sectional view of an essential part of an indirectly heated cathode structure and its vicinity in a prior art cathode ray tube.

As a result of comparing various characteristics such as the leakage current between the heater and the cathode, temperatures of the heater and the cathode, of the indirectly heated cathode in the embodiment of the cathode ray tube of the present invention shown in FIG. 1, with those of the indirectly heated cathode of the prior art color cathode ray tube shown in FIG. 5, it was confirmed that there are no problems with characteristics such as electron emission because the present invention provides a great advantage that the leakage current between the heater and the cathode has been reduced by about 30% in the present invention compared with that in the prior art, and there were no differences in the temperatures of the heater and the cathode between the present invention and the prior art.

When attention is paid to a condition of contact between the cathode sleeve and the heater in the vicinity of the flared bottom end of the cathode sleeve, the end of the overlapped portion of the insulating film and the coating film in the present invention is within the cathode sleeve and is away from the flared bottom end of the cathode sleeve, and consequently, the contact area between the cathode sleeve and the heater in the present invention is made smaller than that in the prior art, and it is thought that this fact also contributes to the reduction of the leakage current between the heater and the cathode.

By employment of a plural-layer winding configuration for leg portions connected to a major heating portion of the heater intended for heating the base metal of the cathode, the following advantages are obtained:

(a) breakage of the heater is prevented because of increased mechanical strength, and (b) electrical resistances of the leg portions, that is, the electrical resistances of the portions other than the major heating portion of the heater are reduced such that the heat-generating region of the heater is concentrated into a top portion of the heater adjacent to the base metal of the cathode, and consequently, the efficiency of utilization of the heat generated by the heater is increased and power consumption of the heater is reduced.

However, the plural-layer winding configuration of the leg portions had a disadvantage in that it increases the diameter of the heater in the vicinity of the bottom end of the cathode sleeve, and consequently, it increases the contact area between the heater and the vicinity of the bottom end of the cathode sleeve.

But the above configuration of the present invention has eliminated the above disadvantage by reducing the contact area between the coating film formed on the insulating film of the heater and the vicinity of the bottom end of the cathode sleeve.

The present invention is not limited to the above configurations, but various changes and modifications can be made without departing from the nature and spirit of the present invention.

As explained above, the present invention specifies a positional relationship between the insulating film and the coating film of the heater and the cathode sleeve in the indirectly heated cathode structure of an electron gun used for a cathode ray tube, thereby preventing the leakage current between the heater and the cathode and consequently, making it possible to employ an automatic cutoff-voltage control circuit for a monitor set or the like and thereby facilitate the adjustment of the monitor set or the like, prevent breakage of the heater and short circuit between the heater and the cathode, and consequently, the present invention provides a cathode ray tube superior in reliability.

What is claimed is:

1. A cathode ray tube having an evacuated envelope including a panel portion, a neck portion, a funnel portion for connecting said panel portion and said neck portion and a stem having a plurality of pins therethrough and being sealed to close said neck portion at one end thereof, a phosphor screen formed on an inner surface of said panel portion, an electron gun housed in said neck portion, said electron gun having an indirectly heated cathode structure and a plurality of electrodes disposed downstream of said indirectly heated cathode structure, spaced specified distances apart, arranged axially in a specified order, and fixed by insulating rods for projecting an electron beam toward said phosphor screen, and a deflection yoke mounted around a vicinity of a transitional region between said neck portion and said funnel portion for scanning the electron beam on said phosphor screen, said indirectly heated cathode structure comprising:

a base metal having an electron emissive material coating on an outer top surface thereof;

a metal sleeve having said base metal attached to a first end of said metal sleeve and having a second end opposite from said first end;

a heater housed partly within said metal sleeve, said heater including a major heating portion having a spirally wound heating wire and leg portions connected to respective ends of said major heating portion and comprising heating wires wound spirally in a plurality of layers;

an insulating film covering said major heating portion and a portion of each of said leg portions continuous with said major heating portion; and a black coating film covering a portion of said insulating film extending from said major heating portion toward each of said leg portions, a whole of said black coating film being housed within said metal sleeve.

2. A cathode ray tube according to claim 1, wherein said insulating film is made of alumina.

3. A cathode ray tube according to claim 1, wherein said black coating film contains at least one of tungsten powder and tungsten carbide powder.

4. A cathode ray tube according to claim 2, wherein said black coating film contains at least one of tungsten powder and tungsten carbide powder.

5. A cathode ray tube according to claim 1, where said leg portions comprise heating wires wound spirally in three layers.

6. A cathode ray tube according to claim 2, where said leg portions comprise heating wires wound spirally in three layers.

7. A cathode ray tube according to claim 3, where said leg portions comprise heating wires wound spirally in three layers.

8. A cathode ray tube according to claim 4, where said leg portions comprise heating wires wound spirally in three layers.

9. A cathode ray tube according to claim 1, where said second end is flared.

10. A cathode ray tube according to claim 2, where said second end is flared.

11. A cathode ray tube according to claim 3, where said second end is flared.

12. A cathode ray tube according to claim 4, where said second end is flared.

13. A cathode ray tube according to claim 5, where said second end is flared.

* * * * *